US007081824B2

(12) United States Patent
Gilbert

(10) Patent No.: US 7,081,824 B2
(45) Date of Patent: Jul. 25, 2006

(54) TRACK MONITORING EQUIPMENT

(75) Inventor: David Gilbert, Wirksworth (GB)

(73) Assignee: AEA Technology PLC, Didcot (GB)

( * ) Notice: Subject to any disclaimer, the term of this patent is extended or adjusted under 35 U.S.C. 154(b) by 396 days.

(21) Appl. No.: 10/480,291

(22) PCT Filed: Jun. 17, 2002

(86) PCT No.: PCT/GB02/02671

§ 371 (c)(1),
(2), (4) Date: Dec. 11, 2003

(87) PCT Pub. No.: WO03/006298

PCT Pub. Date: Jan. 23, 2003

(65) Prior Publication Data

US 2004/0173033 A1 Sep. 9, 2004

(30) Foreign Application Priority Data

Jul. 7, 2001 (GB) ..... 0116651.1

(51) Int. Cl.
*G08B 21/00* (2006.01)

(52) U.S. Cl. ..... 340/686.2; 73/490; 73/493; 73/503; 73/506; 73/510; 33/285; 33/287

(58) Field of Classification Search ..... None
See application file for complete search history.

(56) References Cited

U.S. PATENT DOCUMENTS

| | | | | |
|---|---|---|---|---|
| 3,463,095 | A * | 8/1969 | Plasser et al. | 104/8 |
| 3,517,307 | A * | 6/1970 | Wallen, Jr. et al. | 324/662 |
| 3,599,543 | A * | 8/1971 | Kerridge | 404/117 |
| 4,064,481 | A * | 12/1977 | Silverman | 367/190 |
| 4,649,751 | A * | 3/1987 | Onoda et al. | 73/658 |
| 5,233,797 | A * | 8/1993 | Uno et al. | 52/1 |
| 6,212,454 | B1 * | 4/2001 | Foo et al. | 701/45 |

FOREIGN PATENT DOCUMENTS

| | | |
|---|---|---|
| GB | 1351389 | 4/1974 |
| WO | 00/70148 | 11/2000 |

* cited by examiner

*Primary Examiner*—Benjamin C. Lee
(74) *Attorney, Agent, or Firm*—William H. Holt

(57) ABSTRACT

The alignment of railway tracks may be monitored using an accelerometer (36) mounted on a bogie (24) of a railway vehicle to detect lateral accelerations, and a displacement transducer (38) to monitor the lateral displacements of a wheelset (27) relative to the bogie. The acceleration signals are digitised, and processed corresponding to double integration, so as to deduce the lateral displacements of the bogie, and in conjunction with the signals from the displacement transducer hence to determine the effective lateral displacements of the track. This can provide a more useful indication of the lateral positions of the rails than measurements of the gauge faces. Such equipment (16) may be installed in a service vehicle, and operate automatically, downloading resulting data to a remote base station at regular intervals.

5 Claims, 2 Drawing Sheets

TRACK MONITORING EQUIPMENT

This invention relates to equipment for monitoring railway tracks, in particular for determining their alignment, that is to say their longitudinal profile in plan.

Track recording vehicles are known, which include instruments for measuring many different attributes of a railway track. Such vehicles are expensive both to purchase and to operate, and consequently railway maintenance staff can inspect their lines only at infrequent intervals—typically once a month on the busiest lines, and less frequently on other lines. Equipment to enable frequent and regular monitoring of track condition on substantially the entire railway network would be beneficial, particularly in providing information about the effect of railway traffic on track condition, and in quantifying the effect of maintenance. Such frequent monitoring will also enable railway staff to decide when to remove speed restrictions which may be imposed after track maintenance, and indeed when to impose speed restrictions if track quality decreases. If track quality could be measured on a daily basis, this would also improve railway safety, and decrease the risk of derailment.

Track monitoring equipment is described in WO 00/70148 for measuring the profile of a railway track, using an accelerometer measuring the vertical acceleration of a bogie and a linear displacement transducer measuring the vertical displacement of an axle relative to the bogie. Combining these measurements enables the profile of the top surface of the rail along its length to be monitored, because the wheels rest on the upper surface of the rail and are integral with the axle (forming a wheelset), so that vertical undulations in the rail have a direct effect on the wheel and hence on the axle. This argument is not applicable in determining the lateral position of the rails, and so the rail alignment, because there is a clearance of about 6 mm between wheel flanges and the side of the rail. Consequently it has been suggested that sensors such as optical sensors might be used to detect the lateral positions of the rails, these being defined by reference positions on the inner faces (the gauge faces) of the rails at a preset distance typically 15 mm below the rail head. An alternative device pushes a sensor wheel along the gauge face, or a feeler (as described in GB 1 351 389). Such optical sensors are prone to failure as a result of dirt or unsatisfactory lighting, and are somewhat fragile for mounting on a bogie because of the high accelerations experienced. The mechanical sensors, on the other hand, are applicable only at low speeds.

It has now been appreciated that the positions of the gauge faces are not necessarily the most useful indication of the rail lateral position (although they are the easiest for an engineer to measure at the track side). A more useful definition of the rail's lateral position might be given by the position of the contact point between the wheel and the rail. This can vary for different inclination of rail and for changes in rail profiles, independently of the rail gauge face. It is the movement of this contact point that will affect the alignment of the rail as perceived by the wheelset, not the position of the gauge face.

According to the present invention there is provided equipment for monitoring alignment of railway tracks, the equipment comprising sensors including at least one accelerometer mounted on a bogie of a railway vehicle, the accelerometer being arranged to detect lateral accelerations, and a displacement transducer arranged to monitor the lateral displacements of a wheelset of the bogie relative to the bogie, means to digitise signals from the accelerometer and from the displacement transducer, and a computer arranged to process the digitised signals, the process corresponding to double integration, so as to deduce the lateral displacements of the bogie, and in conjunction with the signals from the displacement transducer hence to determine the effective lateral displacements of the track.

The phrase "effective lateral displacements of the track" in this context refers to the lateral displacements of the wheelset that are due to the track; they may be caused by lateral displacements of the rails, or changes in the rail profile or rail inclination. Hence the equipment measures the effectiveness of the track in guiding the wheels laterally. It must be stressed that no measurements are made of the positions of the rails themselves, either by contact or non-contact sensors.

Preferably the equipment also includes a position locating instrument arranged to provide position information to the computer, and automatic means for transferring data from the computer to a base station remotely and at intervals.

Such equipment can be sufficiently small to be installed on a service vehicle, for example a passenger coach, without causing inconvenience to passengers or staff. Operations are totally automatic, so no staff are required to monitor it. Consequently the equipment enables the track along which that service vehicle travels to be monitored on every journey, so the track alignment may be monitored several times a day. Because it is installed in a service vehicle, no additional vehicle operating costs are incurred in performing the track alignment monitoring.

The displacement transducer may be a contact or a non-contact sensor. For a non-contact sensor, inductance or capacitance probes may be used, as only short range measurements (in the range 5 mm to 20.0 mm) are required. Such sensors are highly robust, and unaffected by dirt or light.

The position locating instrument might use GPS. More precise information on position may be obtained using differential GPS, or by detecting the location of objects at known positions along or adjacent to the track such as points or crossings. Dead reckoning methods may also be used, including inertial guidance systems, and measuring distance from known positions.

Surprisingly, track alignment data obtained in this manner provides a better indication to the maintenance engineers of the alignment of the track than measurements on the gauge faces of the rails. Despite the clearance between the flanges and the gauge faces of the rails, the data obtained is consistent for different vehicles for a wide range of values of the wheel/rail effective conicity, and assuming the vehicle is stable in lateral movement. The data has been found to give an accurate indication of rail alignment, and the alignment so determined is related directly to the effect the rail has on a vehicle. The equipment has the further advantage of being applicable in situations where gauge face-based systems are difficult to apply, for example when passing through switches (points) or crossings, and in situations when optical systems for monitoring lateral rail position may fail (such as bright sunlight, or snow).

The invention will now be further and more particularly described, by way of example only, and with reference to the accompanying drawings, in which.

Figure 1:
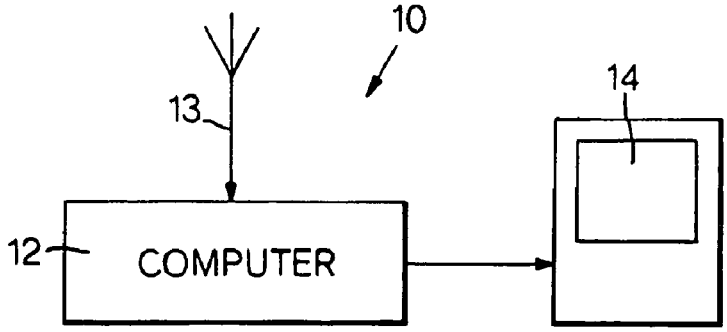
FIG. 1 shows a side view, partly diagrammatic, of a vehicle incorporating a track monitoring system.
Figure 1:
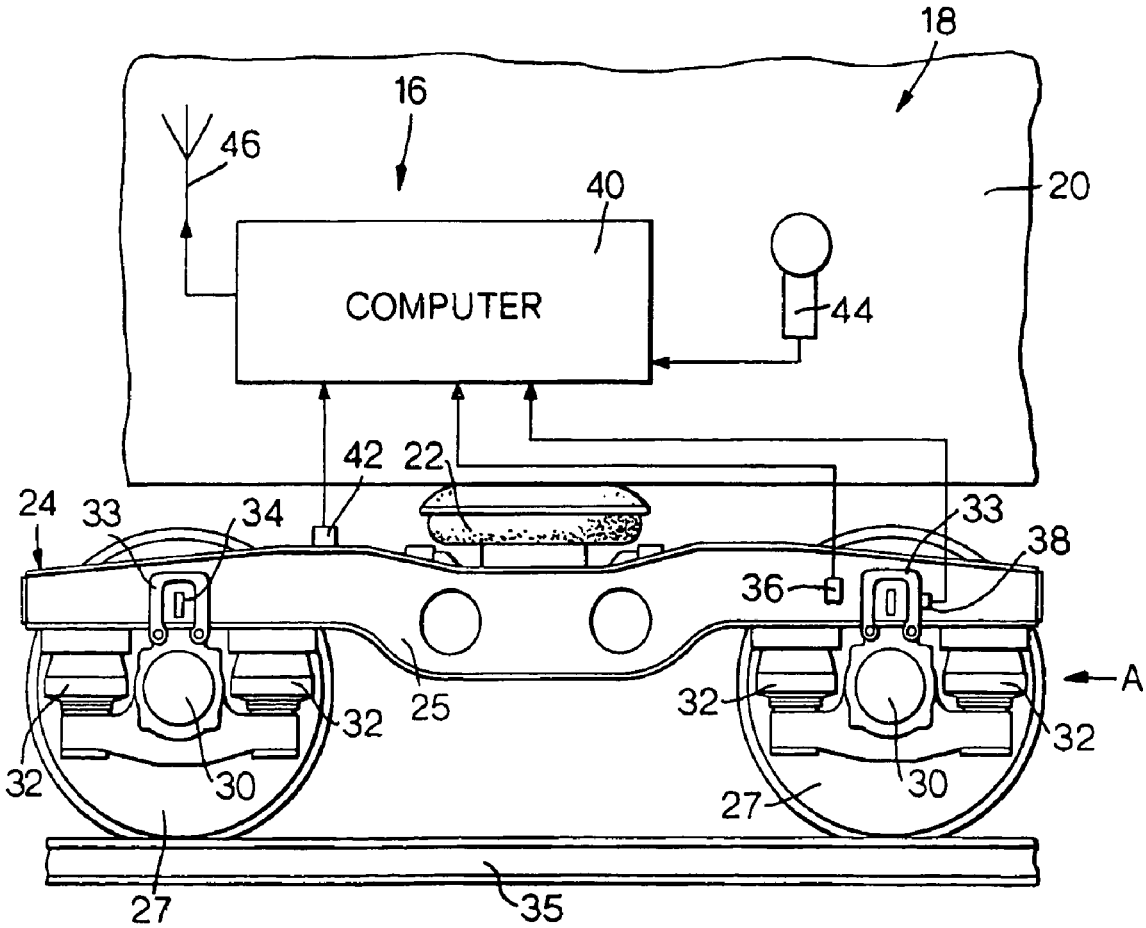
Figure 2:
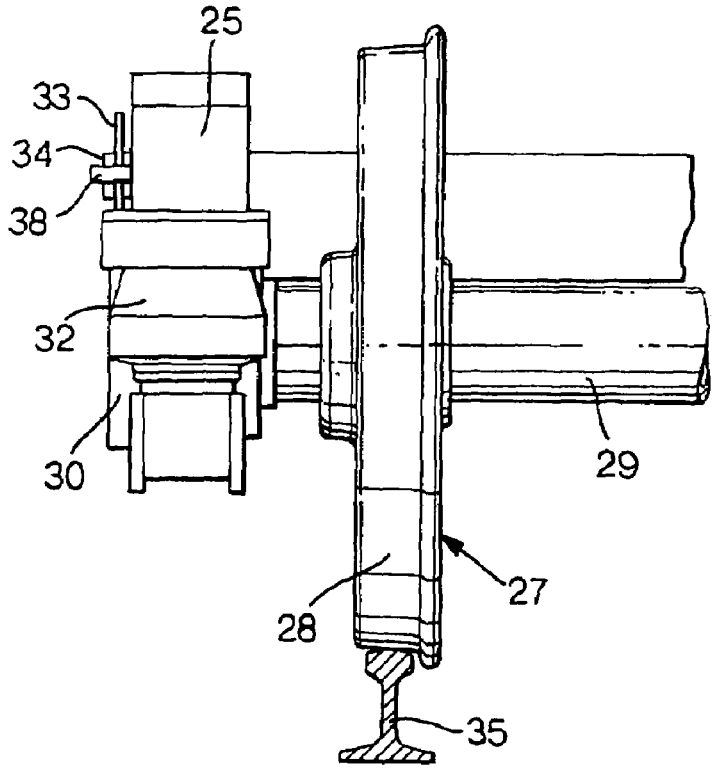
FIG. 2 shows a view, partly broken away, in the direction of arrow A of FIG. 1.

Referring to FIG. 1, a track monitoring system 10 includes a base station computer 12 connected to an aerial 13 and to a display screen 14. The system 10 also incorporates instrumentation packages 16 (only one is shown) which are installed in service vehicles, typically no more than one such instrumentation package 16 in any one train. The figure shows a side view, partly diagrammatic, of parts of a vehicle 18 comprising a body 20 supported on air springs 22 on bogies 24 (only one of which is shown). The bogie 24 includes an H-frame 25 and two wheelsets 27, and, referring also to FIG. 2, each wheelset 27 comprises two wheels 28 integral with an axle 29. At each end the axle 29 locates in a bearing in an axle box 30, the axle box 30 being connected by rubber springs 32 to the frame 25 so that the axle 29 and the axle box 30 can undergo limited movement relative to the frame 25. A horseshoe or ring-shaped restraint plate 33 is bolted rigidly to each axle box 30, and a restraint stud 34 projects from the frame 25 through the ring so formed. The wheels 28 roll along a railway track 35.

The instrumentation package 16 includes a lateral accelerometer 36 and a linear displacement transducer 38 at one side of the bogie 24. The accelerometer 36 is attached to the frame 25 above the axle box 30, and the displacement transducer 38 is connected to the frame 25 and linked to the restraint plate 33 so as to measure any lateral displacement of the axle box 30 relative to the frame 25. Signals from the accelerometer 36 and the transducer 38 are provided to a computer 40 within the body 20. A tachometer 42 on the bogie 24 measures the rate of rotation of a wheel 29 and supplies electrical signals to the computer 40. A GPS receiver 44 also provides signals to the computer 40. The computer 40 might for example locate beneath a passenger seat in the vehicle.

The analogue signals from the accelerometer 36 and the transducer 38 are digitised at 1 kHz, in this case within the computer 40. The resulting digital data from the accelerometer 36 is processed (corresponding to integration twice with respect to time) so as to determine the lateral displacements of the frame 25.

The resulting digital data from the accelerometer 36 is processed (corresponding to integration twice with respect to time) so as to determine the lateral displacements of the frame 25. The digital processing uses the method of δ transforms in the modified canonical form (see for example "Digital Control" by W. Forsyth and R. M. Goodall); a conventional bilinear z transform would generate distortions as the speed of the vehicle 18 varies, because the sampling is performed temporally (at 1 kHz) but the data must be filtered spatially. Combining this data on the displacements of the frame 25 with the data from the transducers 38, the lateral displacements of the wheelset 27 can hence be determined as long as there is no play in the axle box 30, so the axle 29 can't move laterally in the axle box 30. Knowing the speed of the vehicle 18 from the tachometer 42, the computer 40 calculates the values of the lateral displacement of the wheelset 27 every eighth of a metre along the track. The signal processing also filters out any long wavelength lateral undulations, for example lateral undulations of wavelength greater than 35 m. The resulting values d thus represent the values of lateral displacement of the wheelset 27 relative to the smooth curve (or straight line) that the railway track is meant to follow.

Figure 3:
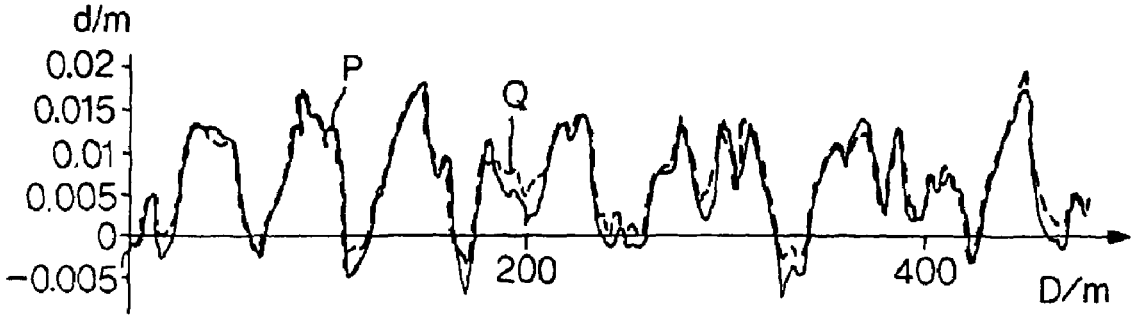
FIG. 3 shows graphically the lateral positions of a wheelset along a track, and corresponding values for the lateral displacement of the track itself.

Referring now to FIG. 3 there are shown graphically (graph P) the variations in lateral displacement of a wheelset, d, along a track, the distance along the track being represented by D. It will be observed that the displacements typically vary between 15 mm one direction and 5 mm in the opposite direction, the peak displacements being about 20 mm. The variations in the lateral position of the track itself (as measured by conventional means) along the same section of track are also shown, as graph Q. It will be observed that there is a very close correlation between the wheelset displacements P and the track displacements Q. This has been found to remain the case for different wheels, different vehicles, and at different speeds.

With good quality track the detailed information as to values of lateral displacement, d, need not be stored, but the computer 40 may be arranged to store detailed information over a distance such as 100 m if the value of d exceeds a threshold value. The values of lateral displacement, d, are usually further processed, by determining the root mean square value of d (say d') over a set distance, for example over a length of 1 eighth of a mile (i.e. one furlong; about 201 m). These values of d' may be used as an indication of the smoothness of the alignment of that length of the track. The computer 40 stores in its memory the values of d' for each such length of track; and at intervals the computer 40 transmits all the stored data, via an aerial 46 to the base station 12. This may be in response to a signal from the base station 12, and may for example be done once a day. The stored and transmitted data is preferably tagged with positional information from the GPS receiver 44. The values of d' can be displayed for every section of track along which the vehicle 18 has travelled. It will be appreciated that storing, transmitting and displaying the values of d' (which are effectively averages taken over a furlong), rather than the values of d (which are determined every eighth of a metre), considerably reduces the quantity of data to be stored, transmitted and displayed.

It will be appreciated that the system 10 might differ from that described above, and in particular it might also measure other parameters concerning the track. For example, sensors mounted on the bogie 24 might measure cant, curvature, or gradient. It is applicable to railway vehicies witn ditferent suspensions, for example the primary suspension might be helical springs in place of the rubber springs 32, and the secondary suspension might also be helical springs, in place of the air springs 22. If the axle 29 can move laterally in the axle box 30, then a non-contact sensor would be used to monitor lateral displacements of the wheelset 27 relative to the frame 25 in place of the transducer 38; such lateral displacements are unlikely to be more than a few mm, so for example an inductance sensor with a range of 15 mm might be arranged on the frame 25 facing a flat part of the face of one wheel 28, at a separation of 10 mm. As a further alternative the computer 40 might be mounted on the underside of the body 20, rather than within it. It will also be appreciated that the signals A might be processed differently, for example being digitised at a different frequency preferably in the range 500 Hz to 3000 Hz, for example at 2 kHz.

The invention claimed is:

1. Equipment for monitoring alignment of railway tracks, the equipment comprising sensors including at least one accelerometer mounted on a bogie of a railway vehicle, the accelerometer being arranged to detect lateral accelerations, means to digitise signals from the accelerometer, and a computer arranged to process the digitised signals, the process corresponding to double integration, so as to deduce the lateral displacements of the bogie, wherein the equipment also comprises a displacement transducer arranged to monitor the lateral displacements of a wheelset of the bogie relative to the bogie, and means to digitise signals from the displacement transducer, the computer being arranged to determine, from the lateral displacements of the bogie in conjunction with the signals from the displacement transducer, the effective lateral displacements (d) of the track.

2. Equipment as claimed in claim 1 also comprising a position locating instrument arranged to provide position information to the computer, and automatic means for transferring data from the computer to a base station remotely and at intervals.

3. Equipment as claimed in claim 1 installed on a service vehicle.

4. Equipment as claimed in claim 1 wherein the displacement transducer is a non-contact transducer.

5. Equipment as claimed in claim 4 in which the displacement transducer is an inductance sensor.

* * * * *